United States Patent [19]

Beck

[11] 4,116,619

[45] Sep. 26, 1978

[54] MULTIPLE BEAM FURNACE

[75] Inventor: Jacob Howard Beck, Waban, Mass.

[73] Assignee: BTU Engineering Corporation, North Billerica, Mass.

[21] Appl. No.: 800,871

[22] Filed: May 26, 1977

[51] Int. Cl.[2] ..... F27D 1/16; F27B 9/14

[52] U.S. Cl. ..... 432/3; 198/774; 432/122

[58] Field of Search ..... 432/3, 122; 198/774, 198/775, 776

[56] References Cited

U.S. PATENT DOCUMENTS

| | | | |
|---|---|---|---|
| 3,633,885 | 1/1972 | Beck | 432/122 |
| 3,749,550 | 7/1973 | Suydam | 432/122 |
| 3,792,965 | 2/1976 | Bengtsson | 432/122 |

*Primary Examiner*—John J. Camby

*Attorney, Agent, or Firm*—Weingarten, Maxham & Schurgin

[57] ABSTRACT

A multiple beam furnace in which the beams can be selectively interconnected for removal as a single unit from the furnace and for replacement into the furnace as a single unit. The movable beams can be raised to a higher position above their normal operating height for engagement of an intermediately disposed fixed beam such that the engaged beams are laterally removable as a single unit from the furnace.

9 Claims, 4 Drawing Figures

MULTIPLE BEAM FURNACE

FIELD OF THE INVENTION

This invention relates to furnaces and more particularly to precision furnaces for heat processing of products and materials.

BACKGROUND OF THE INVENTION

Walking beam furnaces are known for providing stepwise transport of a product through the furnace by cyclic movement of one or more movable beams which are part of the furnace hearth. It is often desired to remove the beams from the furnace for maintenance and repair of the walking beam structure. Removal of the beams also provides access to the furnace arch, furnace walls and heaters from inside of the furnace chamber, which, without beam removal, might require removal of the arch. Beam removal for access to the furnace interior is especially advantageous in furnaces of substantial length, typically 50–100 feet. In furnaces of conventional construction, removal of the beams can be a tedious and time consuming procedure and can result in a considerable period of down-time for the furnace. Moreover, in multiple beam furnaces, each of the beams must be separately disassembled and removed.

SUMMARY OF THE INVENTION

In accordance with this invention, a multiple beam furnace is provided in which the beams can be selectively interconnected for removal as a single unit from the furnace and for replacement into the furnace as a single unit. In a preferred embodiment, first and second movable beams are employed in association with an intermediate fixed beam. The movable beams include a first structural assembly having a plurality of inclined planes and associated rollers coupled to the beams and operative to provide elevating and lowering motion to the beams. A second assembly is coupled to the first assembly and to the beams and is operative to provide lateral beam movement. Cyclic motion is imparted to the beams by motive means such as hydraulic cylinders disposed at one or both ends of the furnace to provide sequential movement of the beams. The walking beam conveyor is itself the subject of U.S. Pat. No. 3,633,885, assigned to the same assignee as this invention.

In the furnace of the present invention, the walking beams are constructed and operative to be raised to a higher position above the normal operating height for engagement of the fixed beam by the movable beams and raising of the fixed beam off of its support such that the beams can be laterally removed from the furnace as a single unit, and also installed in the furnace as a single unit. Although the embodiment to be described shows two movable beams and one intermediate fixed beam, the invention is not to be thereby limited, as the invention is applicable to multiple beam furnaces having greater numbers of beams.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
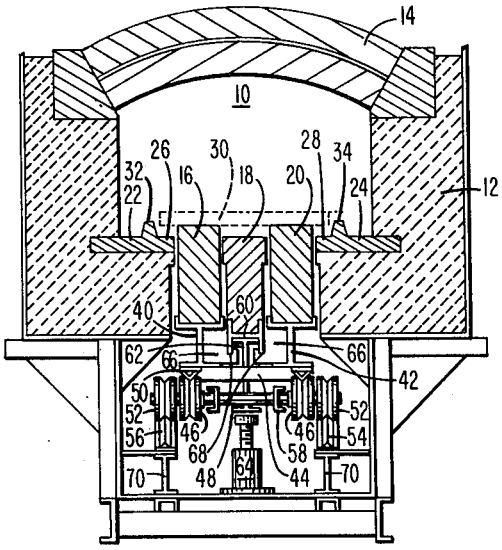
FIG. 1 is a sectional end elevation view of a furnace embodying the invention, with the movable beams in their highest position.

Referring to FIGS. 1–4, there is shown a multiple beam furnace according to the invention and including a furnace chamber 10 defined by walls 12 and arch 14 which typically are formed of a high temperature ceramic and which extend along the active length of the furnace. Three beams 16, 18 and 20, formed of a high temperature ceramic, are supported between side members 22 and 24. Each side member has a respective shoulder portion 26 and 28 adapted to support a suitably sized product carrier 30. The side members also include respective upstanding flanges 32 and 34 to maintain the position of the product carriers during stepwise transport through the furnace in response to the movement of the walking beam assembly.

The beams 16 and 20 each include an upper surface which forms part of the furnace hearth and are each supported by a respective elongated structural member 40 and 42 horizontally disposed along the length of the furnace and below the furnace chamber. Members 40 and 42 are transversely joined by cross-members 44 spaced along the length of the furnace. The members 40 and 42 are supported by a plurality of rollers 46 arranged in pairs along the length of beams 16 and 20, each pair being rotatably disposed on a shaft 48 attached to channel members 58. In the illustrated embodiment, the rollers 46 are grooved and are cooperative with V-shaped members 50 affixed to members 40 and 42 and serving as rails for maintaining the alignment of the movable beams.

A second plurality of grooved rollers 52 are rotatably disposed in pairs on shafts 48, each roller 52 being cooperative with a respective inclined plane 54 disposed along the length of the furnace on respective opposite sides of the support members 40 and 42. V-shaped members 56 are disposed on the inclined planes 54 for engagement of grooved rollers 52.

The fixed beam 18, disposed intermediate the movable beams 16 and 20, is supported by a member 60 extending along the length thereof and which, in turn, is supported by a plurality of members 62 which are supported by respective jacks 64. The jacks are adjustable to elevate beam 18 to a desired position with the upper surface thereof in the plane of the furnace hearth.

A plurality of plates 66 are welded or otherwise affixed to members 40 and 42 and spaced along the length thereof, these plates 66 having hook ends 68 arranged to engage the downwardly extending flanges of member 60 when beams 16 and 20 are in their highest position in order to interconnect the beams 16, 18 and 20 for removal as a single unit. The inclined planes 54 are supported by a pair of I-beams 70 or other suitable support members which extend along the length of the furnace. The inclined planes are removable from the supports 70 and replaceable with rail sections 72 which are aligned with rails 74 disposed along the top surface of each support 70 to provide a pair of effectively continuous rails for beam removal, as will be further described.

Cyclic motion is imparted to the beams 16 and 20 by hydraulic cylinders or other motive means disposed at one or both ends of the furnace. In the illustrated embodiment a pair of hydraulic actuators 76 and 78 are respectively coupled to members 58 and 44. Channel member 58 is movable, in response to a driving force by the associated actuator 76, by means of rollers 52 upon inclined planes 54 causing corresponding movement of beams 16 and 20. In response to the associated actuator 78, member 44 is then movable on rollers 46 to provide lateral movement of beams 16 and 20. By sequential operation of the actuators, the beams 16 and 20 are cyclically moved to provide stepwise transport of the product or product carrier along the movable hearth and through the associated furnace chamber. During normal conveyor operation, the hook ends 68 remain out of engagement with support 60.

In their upper operating position, beams 16 and 20 are disposed with their upper surfaces above shoulder portions 26 and 28 to raise the product carriers supported thereon off the shoulders. The carriers are laterally moved in this raised position to a position forwardly of their former position. In their lower operating position, beams 16 and 20 are moved to their initial position for commencement of another cycle of operation. The operation of the movable hearth conveyor itself is well known in the art and is described in detail in the aforesaid U.S. Pat. No. 3,633,885.

Figure 2:
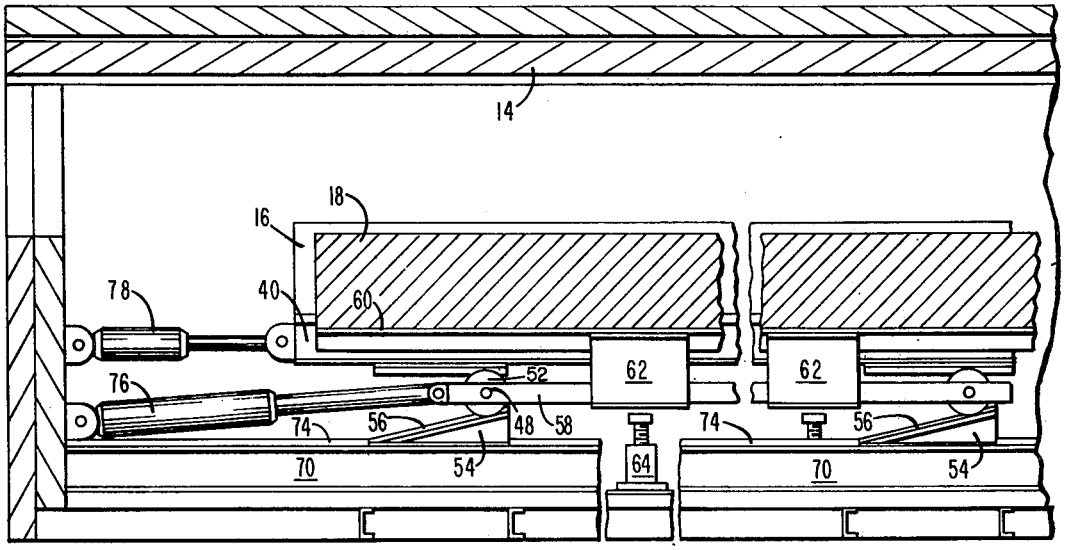
FIG. 2 is a cutaway side elevation view of a furnace embodying the present invention, with the movable beams in their highest position.
Figure 3:
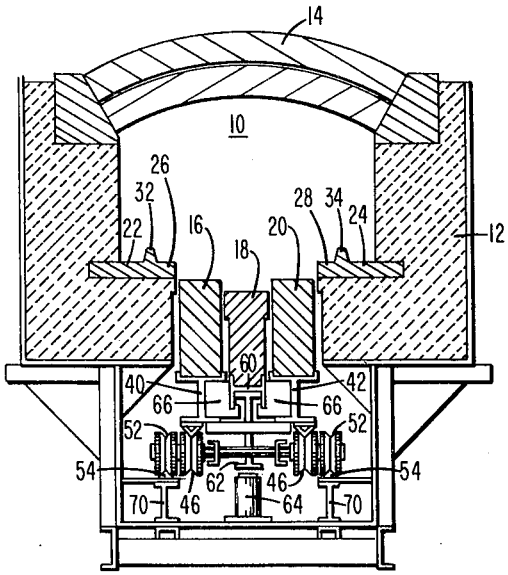
FIG. 3 is a sectional end elevation view of a furnace embodying the invention, with the movable beams in their lowered position on rails.
Figure 4:
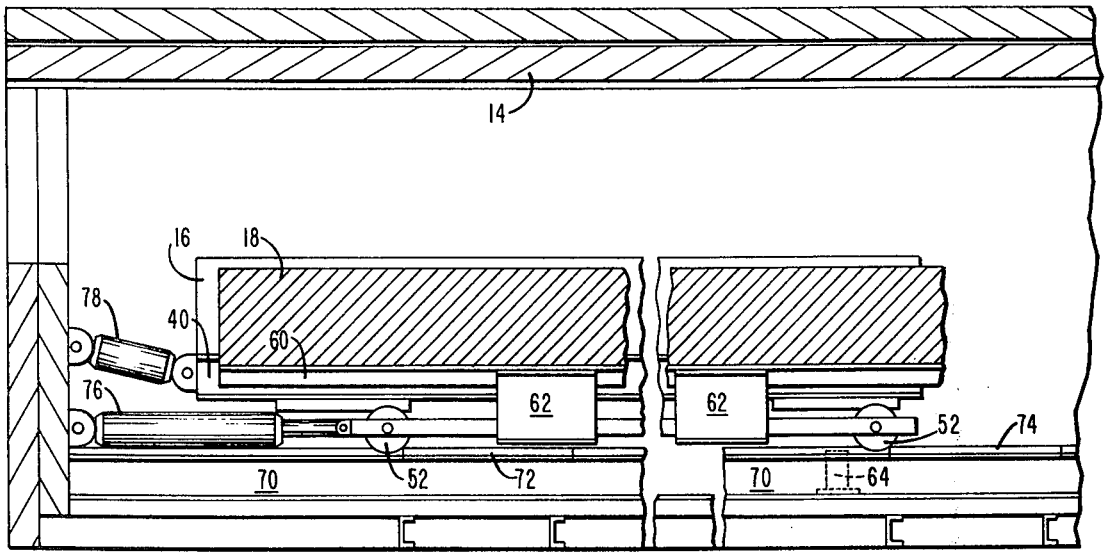
FIG. 4 is a cutaway side elevation view of a furnace embodying the invention, with the movable beams in their lowered position on rails.

In accordance with the invention, beams 16 and 20 are raised to a position above their upper operating position, as shown in FIGS. 1 and 2. The movable beams 16 and 20 are raised to their highest position on inclined planes 54 by actuator 76. In this elevated position, the hook ends 68 engage support 60 of beam 18 and raise beam 18 off of jacks 64. The beam 18 is, in this elevated position, engaged and supported by beams 16 and 20. For purposes of safety, a suitable lock is preferably provided to prevent inadvertent or accidental transport of the beam assembly to the removal position uppermost on the inclined planes. After engagement of beam 18 by beams 16 and 20, the jacks 64 are lowered and removed from the furnace, as shown in FIG. 4, or alternatively, the jacks are lowered to a level below the lowermost level of shaft 48, as shown in dotted outline in FIG. 4. The beams 16 and 20, and beam 18 carried thereby, are then lowered by actuator 76 on inclined planes 54 onto rails 74 which are in alignment with the rails 56 on the inclined planes. FIG. 3 shows the beam assembly in its lowered position on rails 74. The inclined planes 54 are then removed from the furnace and in their place rail sections 72 are installed (FIG. 4) onto supports 70 to provide an effectively continuous rail by which the interconnected beams 16, 18 and 20 can be rolled out of the furnace. Preferably, a pair of rails is disposed outside of the furnace in alignment with the rails 74 and onto which the beam assembly is moved. The beam assembly is thus readily removed from the furnace for repair and maintenance and in addition, the furnace interior is accessible for repair and maintenance purposes.

The beam assembly is easily installed back in the furnace by a reverse procedure. The interconnected beams 16, 18 and 20 are wheeled into the furnace on rails 74 to a position at which rail sections 72 can be removed and replaced with inclined planes 54. The beams are then moved up the inclined planes by actuator 76 to the position above the upper operating position, and jacks 64 are re-installed and adjusted to an intended height. Beams 16 and 20 are then moved downward by actuator 76 on the inclined planes to lower beam 18 onto jacks 64 and disengage the hook ends 68 of plates 66 from support 60. The beams 16 and 20 are again operative to provide stepwise transport of product carriers through the furnace chamber.

It will be appreciated that the invention is not limited to the particular embodiment shown and described. For example, the invention is applicable to multiple beam furnaces having different numbers of beams, and is also applicable to furnaces in which the movable beams are independently movable, rather than movable in unison as in the embodiment described herein. Accordingly, the invention is not to be limited except as indicated in the appended claims.

What is claimed is:

1. A multiple beam furnace comprising:

an elongated furnace chamber formed of a high temperature material and having a hearth which includes shoulder portions disposed along the length thereof and adapted to support product carriers thereon;

first and second beams at least coextensive with the active length of said furnace chamber, each beam formed of a high temperature material and having an upper surface confronting said chamber and serving as part of the furnace hearth, and adapted for cyclic vertical and horizontal movement;

a third beam supported in a fixed position intermediate said first and second beams and formed of a high temperature material and having an upper surface confronting said chamber and serving as part of a furnace hearth, said third beam being in fixed position during cyclic movement of said first and second beams for the transport of product carriers through the furnace chamber;

first means coupled to said first and second beams and operative to elevate said first and second beams to a position above the plane of said shoulder portions to raise product carriers off of said shoulder portions and to lower said first and second beams to a position below the plane of said shoulder portions to replace product carriers onto said shoulder portions;

second means coupled to said first and second beams and to said first means and operative to provide lateral movement of said first and second beams along the axis of said furnace in a first direction when said first and second beams are in their upper position, and in an opposite direction when said first and second beams are in their lower position;

means for providing cyclic operation of said first and second beams to transport product carriers in stepwise fashion through said furnace chamber;

means coupled to said first and second beams and operative to move said first and second beams to a position to cause engagement and support of said third beam by said first and second beams; and means for removing said engaged beams as a single unit from the furnace.

2. A multiple beam furnace comprising:

an elongated furnace chamber formed of a high temperature material and having a hearth which includes shoulder portions disposed along the length thereof and adapted to support product carriers thereon;

first and second beams at least coextensive with the active length of said furnace chamber, each beam formed of a high temperature material and having an upper surface confronting said chamber and serving as part of the furnace hearth, and adapted for cyclic vertical and horizontal movement;

a third beam supported in a fixed position intermediate said first and second beams and formed of a high temperature material and having an upper surface confronting said chamber and serving as part of a furnace hearth, said third beam being in fixed position during cyclic movement of said first and second beams for the transport of product carriers through the furnace chamber;

first means coupled to said first and second beams and operative to elevate said first and second beams to a position above the plane of said shoulder portions to raise product carriers off of said shoulder portions to lower said first and second beams to a position below the plane of said shoulder portions to replace product carriers onto said shoulder portions;

second means coupled to said first and second beams and to said first means and operative to provide lateral movement of said first and second beams along the axis of said furnace in a first direction when said first and second beams are in their upper position, and in an opposite direction when said first and second beams are in their lower position;

means for providing cyclic operation of said first and second beams to transport product carriers in stepwise fashion through said furnace chamber;

means operative to elevate said first and second beams to a position above said upper position;

means operative upon elevation of said first and second beams to the position above said upper position to cause engagement and support of said third beam by said first and second beams; and means for removing said engaged beams as a single unit from the furnace.

3. The furnace of claim 2 wherein said first means includes:

a first elongated structure disposed below and supporting said first and second beams;

a plurality of inclined planes disposed in pairs below said furnace along the length thereof on respective opposite sides of said first structure, each having a like inclined surface confronting said furnace chamber;

a plurality of rollers attached to said first structure, each roller being rotatably supported on a respective inclined plane to maintain said first and second beams in level disposition within said furnace chamber;

said second means including a second elongated structure attached to and supporting said first and second beams and slidably attached to said first structure;

said rollers cooperative with each pair of inclined planes being rotatably attached to a shaft which also rotatably supports rollers arranged for slidable movement of said second structure;

said cyclic-operating means including:

a first driving element disposed at an end of said furnace and coupled to said first structure and operative to raise and lower said first structure on said inclined planes; and a second driving element disposed at an end of said furnace and coupled to said second structure to provide lateral movement thereof in a first direction along the axis of said furnace and in an opposite direction.

4. The furnace of claim 3 wherein said removing means includes means below said furnace chamber providing a supporting surface onto which said engaged beams are lowered from said inclined planes for movement as a single unit from the furnace.

5. The furnace of claim 3 wherein said removing means includes a pair of rails below said furnace chamber providing an effectively continuous surface onto which said engaged beams are lowered from said inclined planes for movement as a single unit from the furnace.

6. The furnace of claim 2 wherein said means operative to cause engagement includes:

a plurality of structural elements disposed along the length of and coupled to said first and second beams and operative upon elevation of said first and second beams to the position above said upper position to engage and support said third beam.

7. The furnace of claim 3 wherein said means operative to cause engagement includes:

a plurality of structural elements affixed to said first elongated structure and disposed along the length thereof, each of said structural elements including a hook end disposed and dimensioned to engage the support for said third beam when said first and second beams are elevated to the position above said upper position.

8. In a multiple beam furnace comprising:

an elongated furnace chamber formed of a high temperature material and having a hearth which includes shoulder portions disposed along the length thereof and adapted to support product carriers thereon;

first and second beams at least coextensive with the active length of said furnace chamber, each beam formed of a high temperature material and having an upper surface confronting said chamber and serving as part of the furnace hearth, and adapted for cyclic vertical and horizontal movement;

a third beam supported in a fixed position intermediate said first and second beams and formed of a high temperature material and having an upper surface confronting said chamber and serving as part of a furnace hearth, said third beam being in fixed position during cyclic movement of said first and second beams for the transport of product carriers through the furnace chamber;

first means coupled to said first and second beams and operative to elevate said first and second beams to a position above the plane of said shoulder portions to raise product carriers off of said shoulder portions and to lower said first and second beams to a position below the plane of said shoulder portions to replace product carriers onto said shoulder portions;

second means coupled to said first and second beams and to said first means and operative to provide lateral movement of said first and second beams along the axis of said furnace in a first direction when said first and second beams are in their upper position, and in an opposite direction when said first and second beams are in their lower position; and means for providing cyclic operation of said first and second beams to transport product carriers in stepwise fashion through said furnace chamber;

the method comprising:

elevating said first and second beams to a position above said upper position to cause engagement and support of said third beam by said first and second beams;

removing the support for said third beam;

lowering the engaged first, second and third beams to a supporting surface below the furnace chamber; and moving the engaged beams as a single unit from the furnace

9. The method of claim 8 wherein said moving step includes providing an effectively continuous pair of rails as said supporting surface and onto which the engaged beams are lowered.

* * * * *